US009609985B2

(12) United States Patent
Lodoka

(10) Patent No.: US 9,609,985 B2
(45) Date of Patent: Apr. 4, 2017

(54) TOILET BOWL COVER APPARATUS

(71) Applicant: Lado Lodoka, Garden City, KS (US)

(72) Inventor: Lado Lodoka, Garden City, KS (US)

( * ) Notice: Subject to any disclaimer, the term of this patent is extended or adjusted under 35 U.S.C. 154(b) by 0 days.

(21) Appl. No.: 14/816,194

(22) Filed: Aug. 3, 2015

(65) Prior Publication Data

US 2017/0035259 A1 Feb. 9, 2017

(51) Int. Cl.
*A47K 13/00* (2006.01)
*A47K 13/10* (2006.01)

(52) U.S. Cl.
CPC ..... *A47K 13/10* (2013.01); *A47K 13/00* (2013.01)

(58) Field of Classification Search
CPC ..... A47K 13/00
USPC ..... 4/234–236
See application file for complete search history.

(56) References Cited

U.S. PATENT DOCUMENTS 4,216,553 A * 8/1980 Haberle ..... E03D 9/005 4/223
4,402,091 A * 9/1983 Ellis ..... E03D 9/052 4/217
4,729,133 A * 3/1988 Wileman, III ..... E03D 9/002 4/233
4,745,639 A * 5/1988 Wileman, III ..... E03D 9/002 4/233
4,839,928 A 6/1989 Probasco
4,975,990 A * 12/1990 Chan ..... A47K 13/16 4/245.1
5,210,884 A * 5/1993 Redford ..... E03D 9/052 4/209 FF
5,321,858 A 6/1994 Anderson
5,333,321 A * 8/1994 Redford ..... E03D 9/052 4/209 FF
6,637,040 B1 * 10/2003 Alba ..... E03D 9/052 4/217
6,678,900 B2 * 1/2004 Ware ..... E03D 9/05 4/209 FF
6,701,538 B2 * 3/2004 Hunnicutt, Jr. ..... E03D 9/052 4/213
6,745,417 B2 * 6/2004 Sumino ..... A47K 13/302 4/222
7,117,548 B1 * 10/2006 Reyes ..... A47K 13/307 4/213
7,380,292 B1 * 6/2008 Harris ..... A47K 13/10 4/213

(Continued)

*Primary Examiner* — Lori Baker
(74) *Attorney, Agent, or Firm* — Dale J. Ream

(57) ABSTRACT

A toilet bowl cover apparatus includes a lid housing having a lower portion and an upper portion extending upwardly from a rear end of the lower portion, the portions together defining a continuous interior channel. A flexible lid member is situated in the interior channel and slidably movable between a retracted configuration substantially in the interior channel of the upper portion and a deployed configuration substantially in the interior channel of the lower portion. A toilet seat is operatively coupled to a top surface of the lid housing and selectively movable between raised and lowered configuration. The lower portion of the lid housing defines an opening complementary to a center opening of the toilet seat and to an open top of the toilet bowl. Therefore, the lid member prevents communication between the toilet bowl and the toilet seat the deployed configuration and allows communication therebetween at the retracted configuration.

14 Claims, 16 Drawing Sheets

(56) References Cited

U.S. PATENT DOCUMENTS

| | | | | |
|---|---|---|---|---|
| 7,509,693 | B1 * | 3/2009 | Graves | A47K 13/302 4/233 |
| 7,543,339 | B1 * | 6/2009 | Harris | E03D 9/085 4/420.5 |
| 8,978,172 | B2 * | 3/2015 | Plate | E03D 1/01 4/300 |
| 9,170,720 | B2 * | 10/2015 | Plate | A47K 13/24 |
| 2015/0197928 | A1 * | 7/2015 | McHale | E03D 11/02 4/423 |
| 2015/0267387 | A1 * | 9/2015 | Shinohara | E03D 5/10 4/313 |
| 2016/0002903 | A1 * | 1/2016 | Grover | E03D 11/08 4/405 |

* cited by examiner

TOILET BOWL COVER APPARATUS

BACKGROUND OF THE INVENTION

This invention relates generally to toilet lids, covers, and seats and, more particularly, to a toilet bowl cover apparatus that selectively covers a toilet bowl opening to prevent bacteria, germs, and human waste from direct or indirect contact with a toilet seat.

It is estimated that there are on average 50 bacteria per square inch on a toilet seat, the bacteria often being deposited thereon as a result of being stirred up when a toilet is flushed in order to dispose of fecal or urinary waste from a human being. Toilets in public restrooms are particularly susceptible to becoming quite unsanitary, in part because the may not be cleaned with frequency or the users of them may be less careful than at their own home. While there are actually objects in a person's home that are even larger havens of bacteria and germs, the toilet bowl and toilet seat are certainly havens for undesirable bacteria. Further, Although products to separate a person's skin from contact with a toilet seat have been proposed in the art, such as full toilet seat covers and disposable paper liners, these devices merely attempt to block a user's skin from contact with the bacteria but do not actually prevent the bacteria from ever being deposited on the toilet seat. While toilets may have lids mounted atop respective toilet seats, closure thereof just blocks a view of the toilet bowl and seat but does not prohibit bacteria from being splashed onto the toilet seat when the toilet is flushed.

Therefore, it would be desirable to have a toilet cover apparatus that actually prevents communication between the toilet bowl and the toilet seat. Further, it would be desirable to have a toilet cover apparatus having a lid member that may be deployed beneath the toilet seat prior to flushing the contents collected in the toilet bowl.

SUMMARY OF THE INVENTION

A toilet bowl cover apparatus according to the present invention is for use with a toilet that includes a toilet bowl having an upper rim defining an open top and a tank extending upwardly from the toilet bowl. The cover apparatus includes a lid housing that includes a a lower portion having opposed front and rear ends and an upper portion having opposed lower and upper ends, the lower end of the upper portion being connected to the rear end of the lower portion such that the upper portion extends upwardly relative to the lower portion. The lower and upper portions define a continuous interior channel. A flexible lid member is situated in the interior channel and is slidably movable between a retracted configuration substantially in the interior channel of the upper portion and a deployed configuration substantially in the interior channel of the lower portion.

A toilet seat is operatively coupled to a top surface of the lid housing and selectively movable between a raised configuration generally parallel to the upper portion of the lid housing and a lowered configuration generally parallel to the lower portion of the lid housing. The lower portion of the lid housing defines an opening having a shape that is complementary to a center opening of the toilet seat and to the open top of the upper rim of the toilet bowl. Therefore, the lid member prevents communication between the toilet bowl and the toilet seat when positioned at the deployed configuration and allows communication between the toilet bowl and the toilet seat when positioned at the retracted configuration.

Therefore, a general object of this invention is to provide a toilet cover apparatus that includes a lid member selectively deployed beneath a toilet seat to prevent bacteria collected in a toilet bowl from becoming disposed upon the toilet seat.

Another object of this invention is to provide a toilet cover apparatus, as aforesaid, that positions a lid member beneath a toilet seat rather than on top of it.

Still another object of this invention is to provide a toilet cover apparatus, as aforesaid, that is movable between a retracted configuration allowing a toilet bowl to be accessed and a deployed configuration blocking access to the toilet bowl.

Yet another object of this invention is to provide a toilet cover apparatus, as aforesaid, in which the lid member has a flexible configuration that is slidably movable in a lid housing positioned beneath the toilet lid.

A further object of this invention is to provide a toilet cover apparatus, as aforesaid, that does not significantly change the traditional appearance of a toilet.

A still further object of this invention is to provide a toilet cover apparatus, as aforesaid, that is electrically actuated to move the lid member between retracted and deployed configurations.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
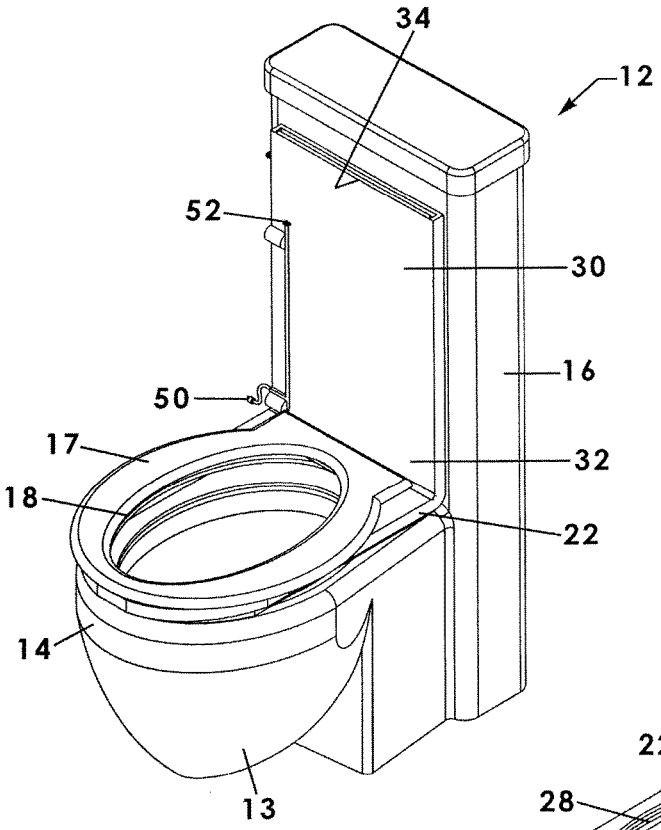
FIG. 1*a* is a perspective view of a toilet cover apparatus according to an embodiment of the present invention illustrated with a toilet seat in a lowered configuration.

A toilet bowl cover apparatus according to embodiments of the present invention will now be described with reference to FIGS. 1 to 15 of the accompanying drawings. The toilet bowl cover apparatus 10 includes a lid housing 20 having upper 34 and lower 32 portions and a flexible lid member 40 slidably movable between retracted and deployed configurations. At the deployed configuration, a toilet seat 17 is protected from bacteria, germs, and waste that may be disrupted when a toilet is flushed.

A traditional toilet 12 includes a toilet bowl 13 configured to hold a quantity of water into which human waste matter such as urine and feces are collected before being flushed away. The toilet bowl 13 includes an upper rim 14 defining an open top giving access into the interior area of the bowl. A toilet includes a tank 16 configured to hold a quantity of "refill water" that is used to facilitate a flushing action and to refill the toilet bowl for a next use. In addition, a toilet seat 17 may be pivotally mounted atop the upper rim 14 of the toilet bowl 13 and is moved between a lowered configuration enabling a person to sit above the open top of the toilet bowl 13 and a raised configuration in which the toilet bowl 13 is accessible when a person is standing. The toilet seat 17 defines a center opening 18 that is in communication with the open top of the upper rim 14 for receiving waste matter therethrough. The present invention may be used in conjunction with a traditional toilet or incorporated into a toilet design as will be described in detail below.

In an embodiment, the lid housing 20 includes a lower portion 22 having opposed front 24 and rear 26 ends and an upper portion 30 having opposed lower 32 and upper 34 ends. The lower end 32 of the upper portion 30 of the lid housing 20 is fixedly attached to the rear end 26 of the lower portion 22 and the upper portion 30 extends upwardly relative to the lower portion 22, such as at about a ninety degree angle. The upper and lower portions of the lid housing 20 combine to define a continuous interior channel 36 extending substantially between the front end 24 of the lower portion 22 to the upper end 34 of the upper portion 30. The interior channel 36 is continuous from the lower portion 22 into the upper portion 30. The interior channel 36 has a width dimension that is substantially the entire width between side edges of both the lower portion 22 and upper portion 30. The lid housing 20 serves as a sleeve in which the lid member 40 may be retracted and deployed. The lower portion 22 of the lid housing 20 defines an opening 28 dimensioned to selectively allow passage of waste matter therethrough at one configuration while blocking the same at another configuration as will be described later.

The lid member 40 is constructed of a generally flexible material, such as a thin plastic or vinyl material. The lid member 40 is situated in the interior channel 36 and dimensioned to extend the entire width thereof. The lid member 40 may have a length that is substantially similar to a length of the upper portion 30 (between respective upper and lower ends) or a length of the lower portion (between respective front and rear ends). The lid member 40 is slidably movable within the interior channel 36 between a retracted configuration situated substantially within the upper portion 30 of the interior channel 36 in the upper portion 30 and a deployed configuration situated substantially within the portion of the interior channel 36 in the lower channel 37.

The lid member 40 completely blocks access through the opening 28 defined by the lower portion 22 when the lid member 40 is moved to the deployed configuration and allows access through the opening 28 when the lid member 40 is at the retracted configuration. The lid member 40, therefore, has length and width dimensions that selectively block the entire opening 28 when the lid member 40 is deployed.

Figure 6B:
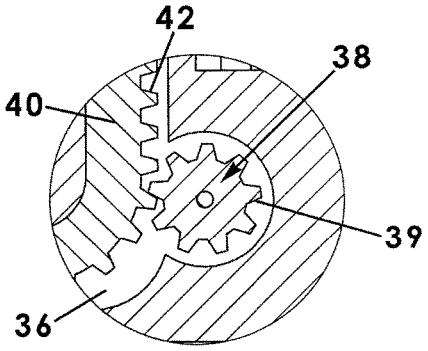
FIG. 6*b* is an isolated view on an enlarged scale taken from FIG. 6*a;*
Figure 6A:
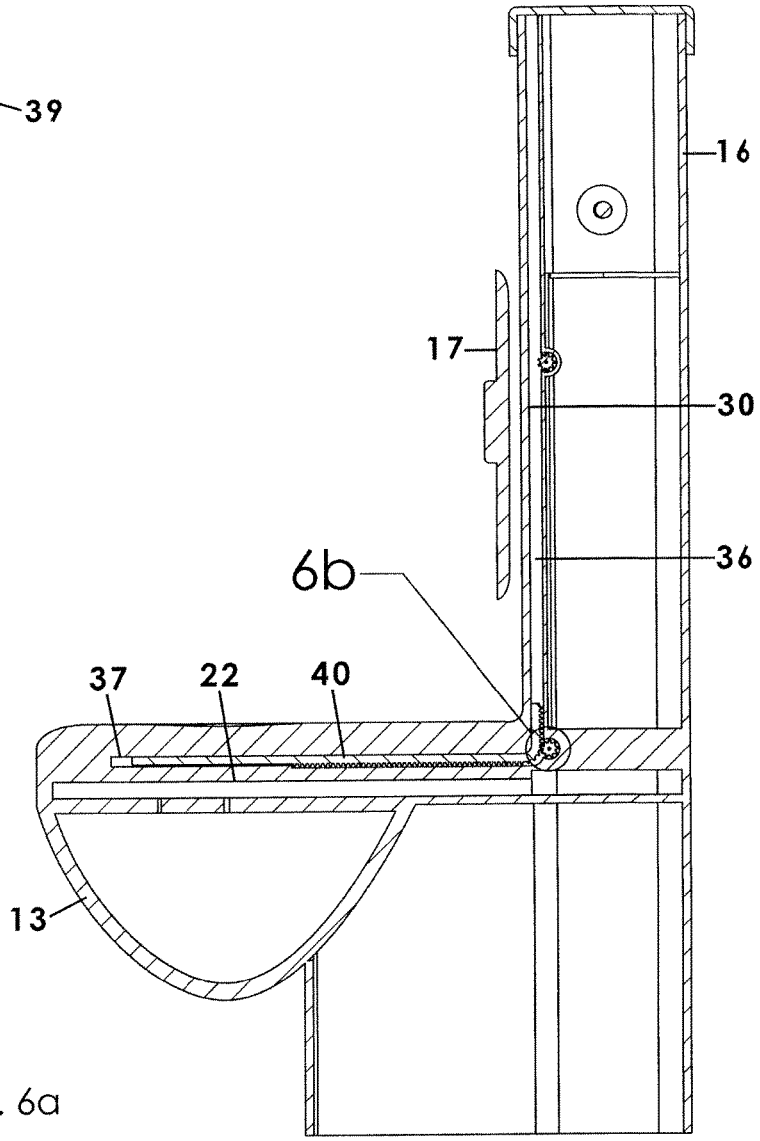
FIG. 6*a* is a sectional view taken along line 6*a*-6*a* of FIG. 5, illustrated with the lid member in a deployed configuration.
Figure 7:
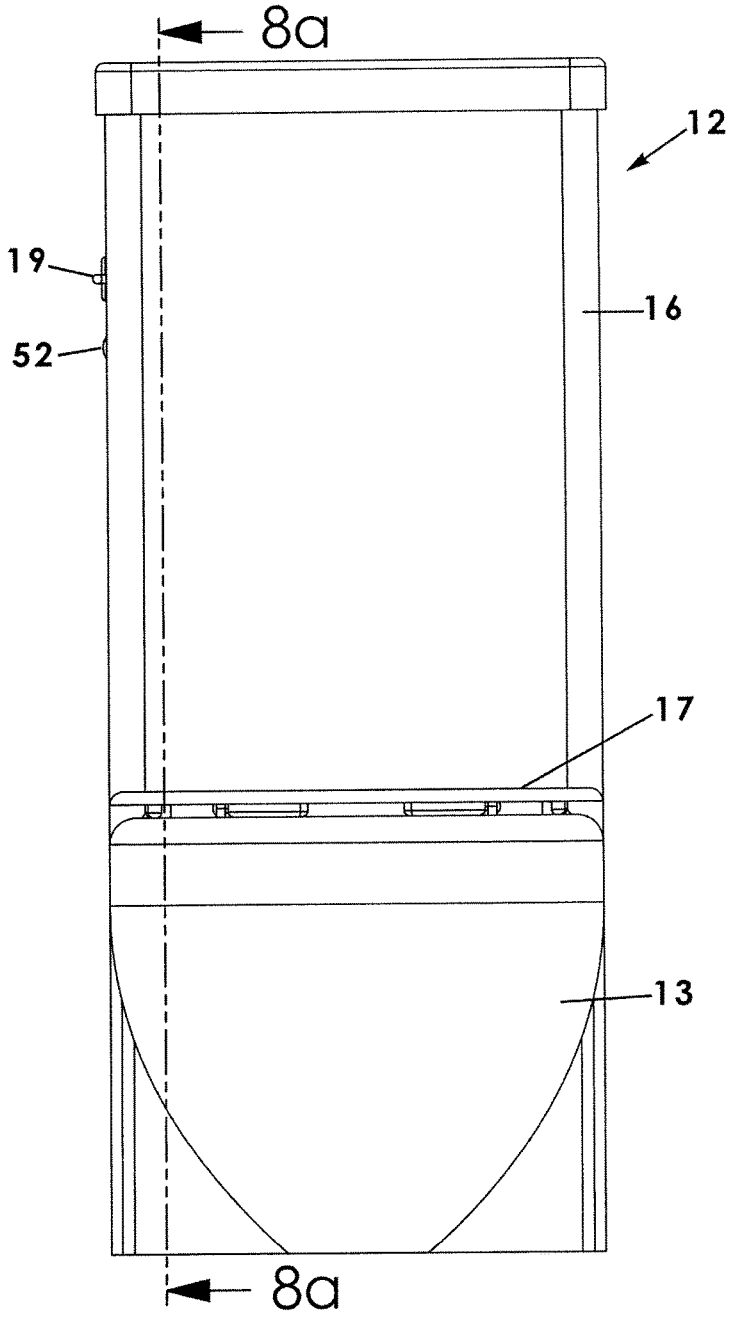
FIG. 7 is another front view of the toilet cover apparatus as in FIG. 4*a;*
Figure 8B:
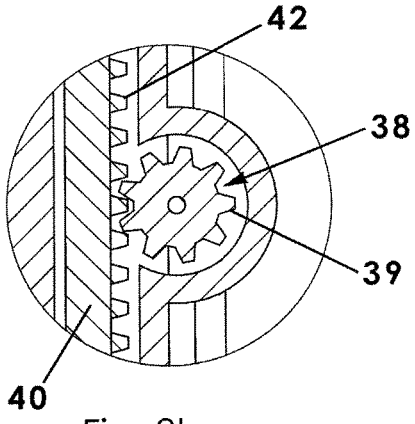
FIG. 8*b* is an isolated view on an enlarged scale taken from FIG. 8*a;*
Figure 8A:
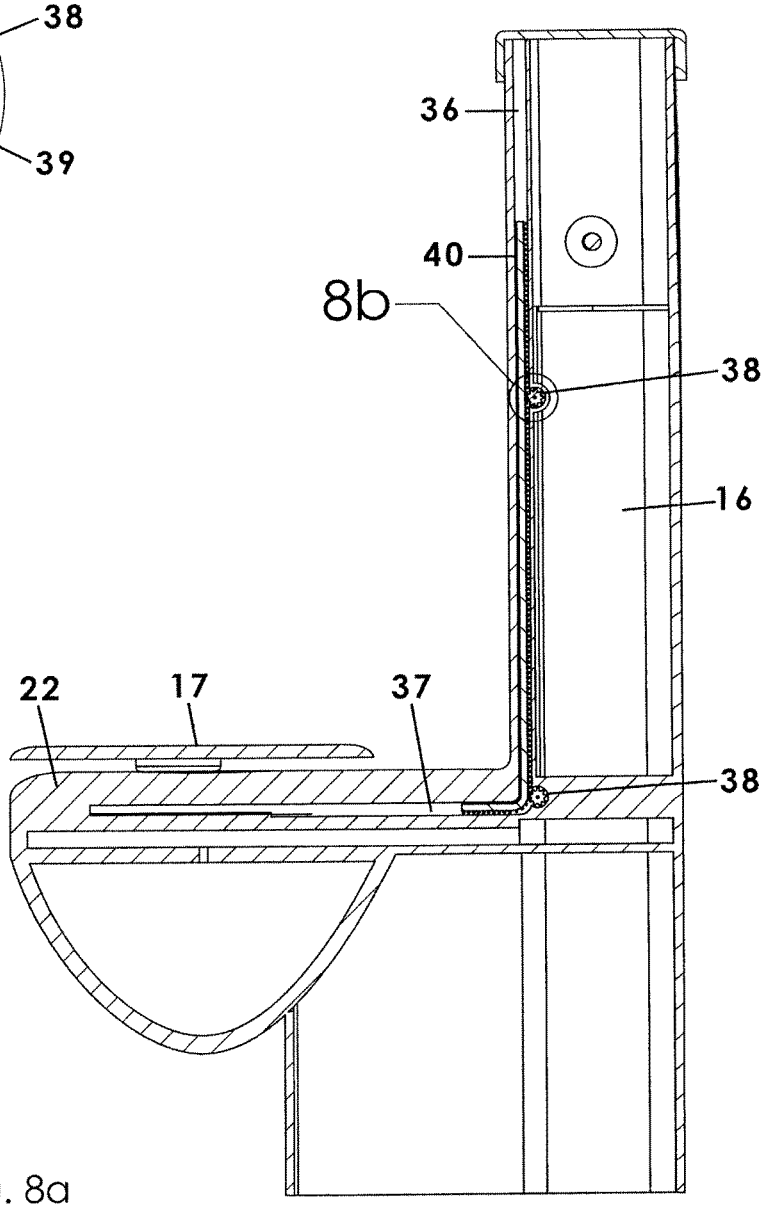
FIG. 8*a* is a sectional view taken along line 8*a*-8*a* of FIG. 7, illustrated with the lid member in a retracted configuration.
Figure 9:
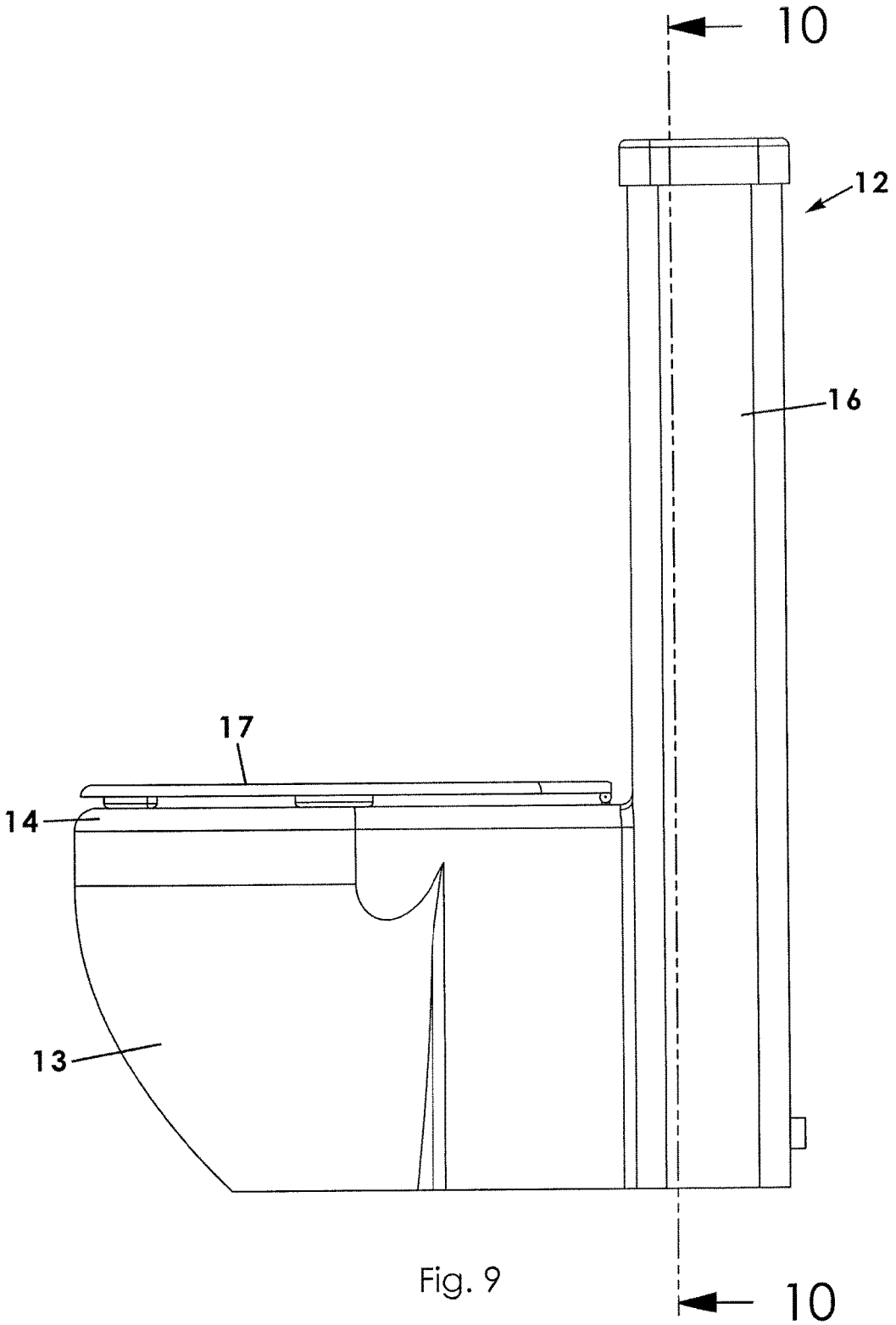
FIG. 9 is a side view of the toilet cover apparatus as in FIG. 1*a;*
Figure 10:
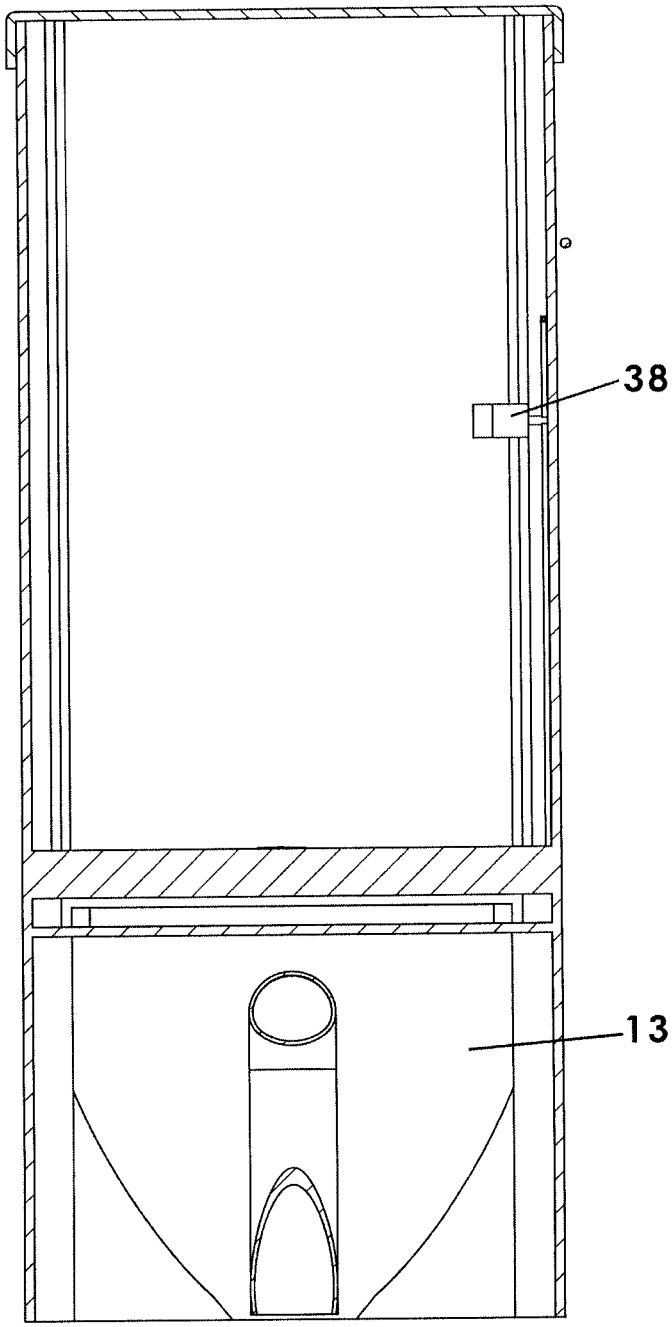
FIG. 10 is a sectional view taken along line 10-10 of FIG. 9.
Figure 11:
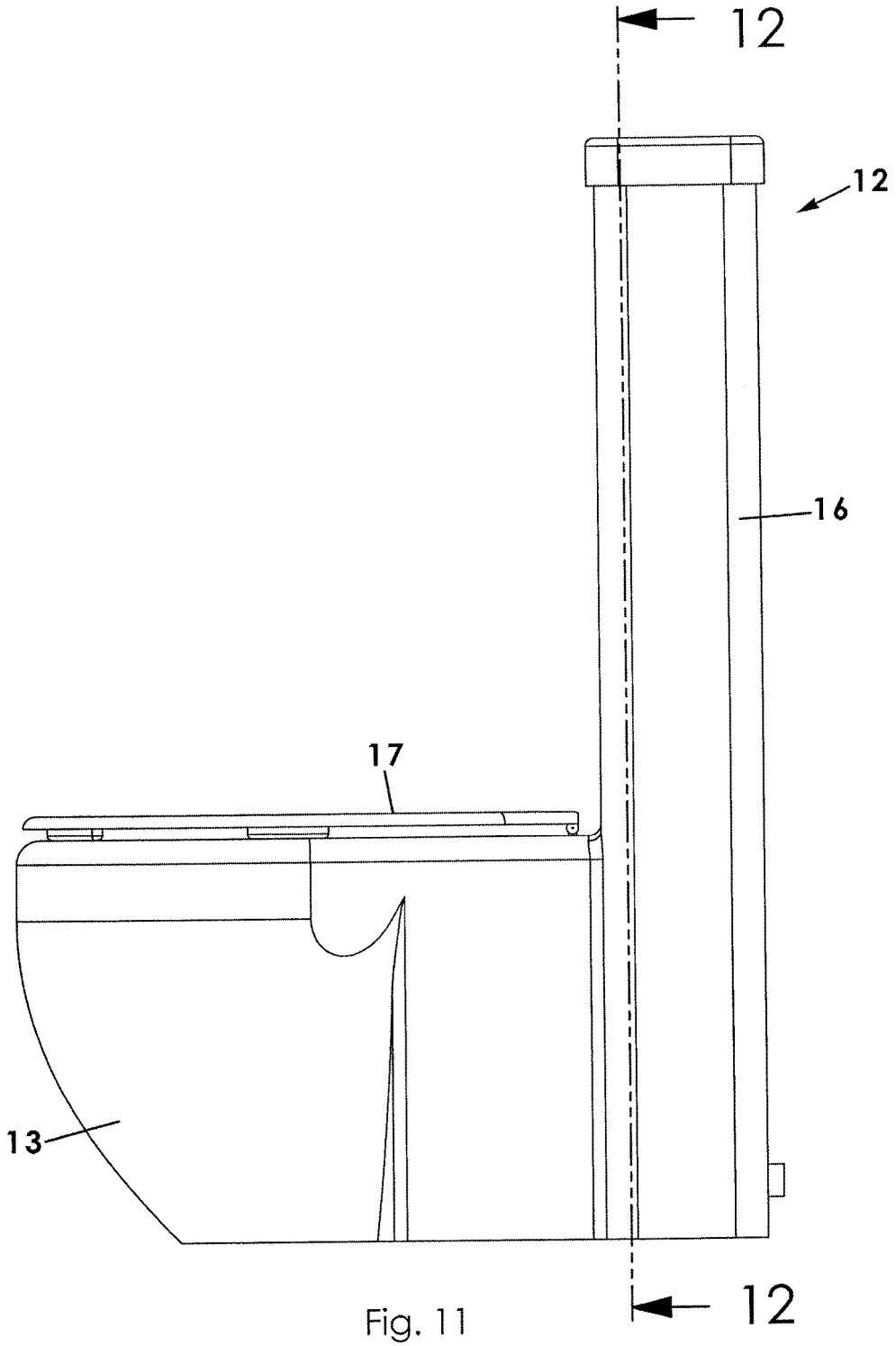
FIG. 11 is another side view of the toilet cover apparatus as in FIG. 1*a;*
Figure 12:
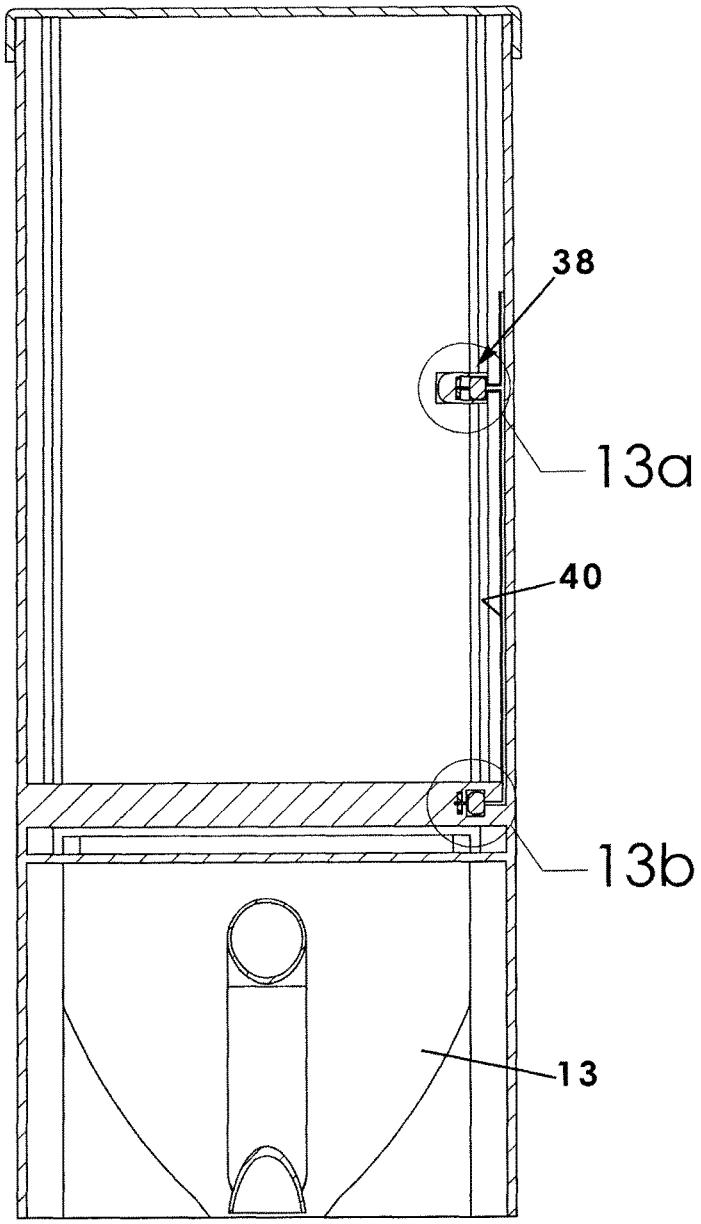
FIG. 12 is a sectional view taken along line 12-12 of FIG. 11.
Figure 13A:
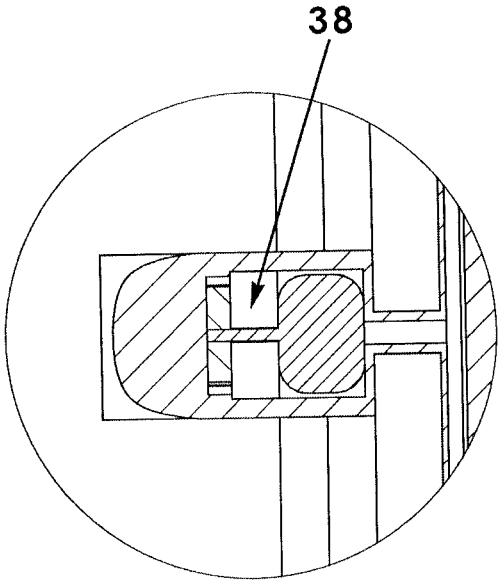
FIG. 13*a* is an isolated view on an enlarged scale taken from FIG. 12.
Figure 13B:
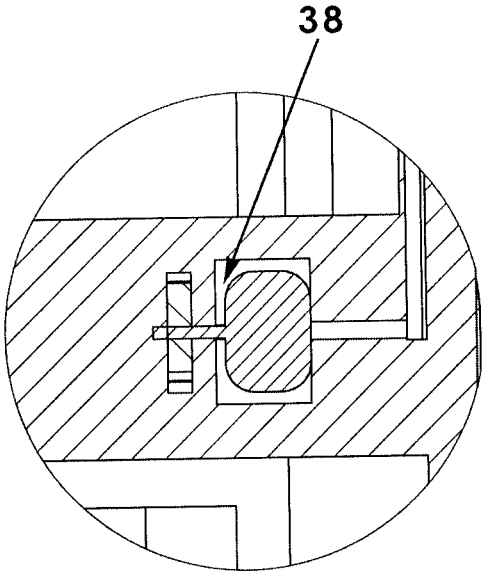
FIG. 13*b* is an isolated view on an enlarged scale taken from FIG. 12.
Figure 14A:
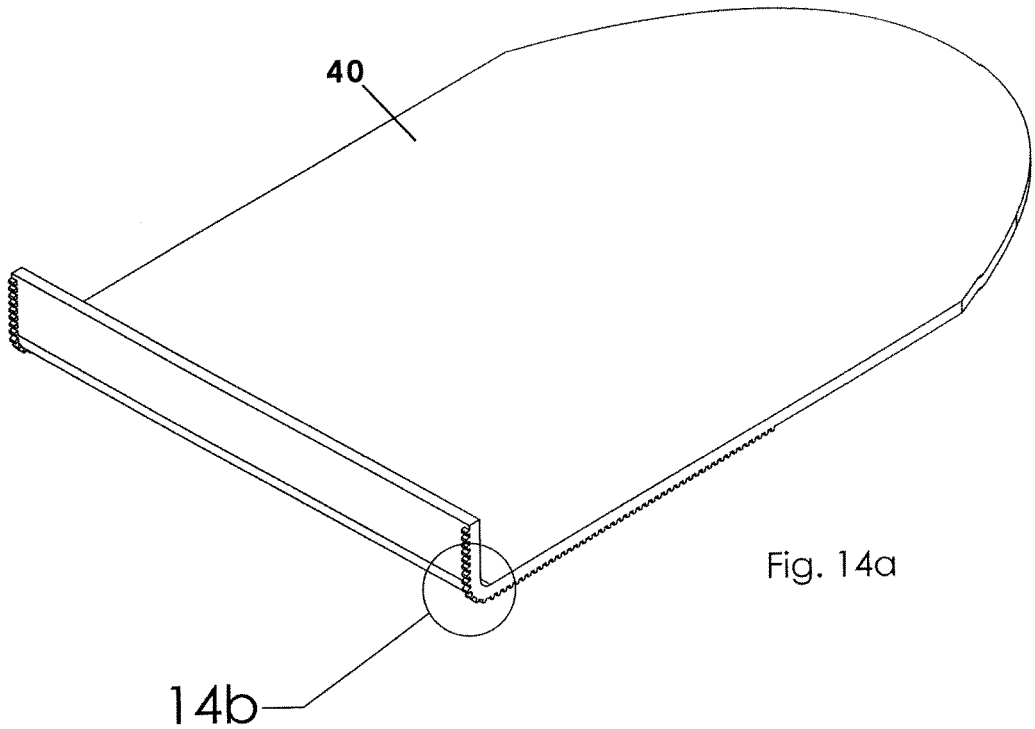
FIG. 14*a* is a perspective view of the lid member as FIG. 3.
Figure 14B:
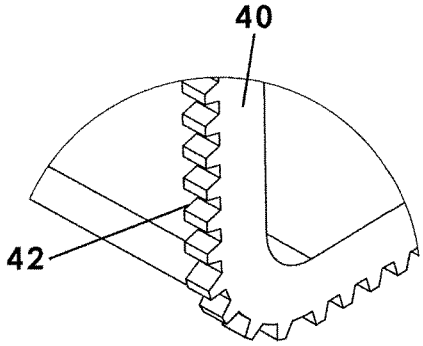
FIG. 14*b* is an isolated view on an enlarged scale taken from FIG. 14*a*.
Figure 15:
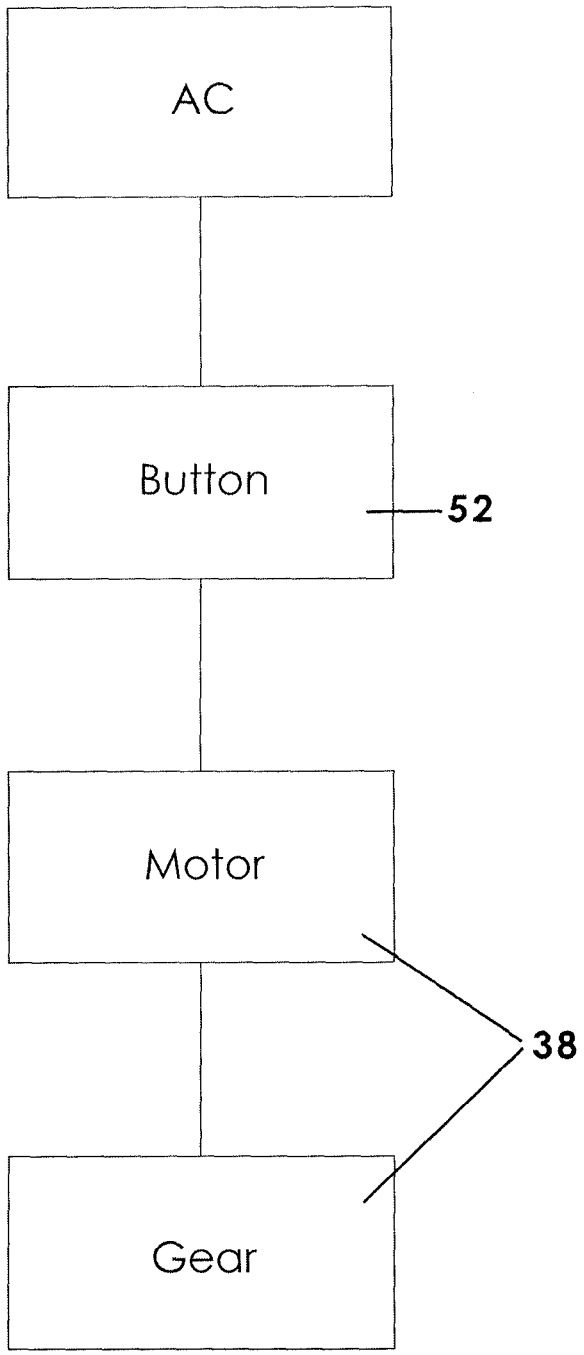
FIG. 15 is a block diagram of electrical components according to the present invention.

With further regard to movement of the lid member 40, the lid member 40 may include a plurality of teeth 42 (hereafter referred to as "lid teeth") spaced apart along a back side thereof, the lid teeth 42 being positioned adjacent opposed peripheral edges of the lid member 40. Further, at least one motor/gear combination 38 may be situated in the interior channel 36 of the lid housing 20, the motor/gear combination 38 having a plurality of gear teeth 39 spaced apart about the gear (FIG. 6*a*). The lid teeth 42 and gear teeth 39 are operatively engaged such that the lid member 40 is slidably moved within the interior channel 36 when the at least one gear/motor combination 40 is energized with current. The gear/motor combination 38 may be electrically connected to an AC power source via a power cord 50. An actuator 52, such as a button or other user interface, may be positioned on the upper portion 30 of the lid housing 20 or on the toilet tank 16 itself and configured to cause the gear/motor combination be energized.

It is understood that the actuator 52 may be electrically connected to the gear/motor combination 38 with wires (not shown), wirelessly, or with another linkage. In one embodiment, operation of the lid member 40 to move between retracted and deployed configurations may be done manually without connection to AC power or may be accomplished using rechargeable DC battery power.

The lid member 40 is positioned relative to the upper rim 14 of the toilet 12 so as to be positioned beneath the toilet seat 17 whether the toilet seat 17 is in the raised configuration or in the lowered configuration. When the lid member 40 is retracted into the upper portion 30 and the toilet seat 17 is in the lower configuration, the center opening 18 of the toilet seat 17, the opening 28 defined by the lower portion 22 of the lid housing 20, and the open top of the upper rim 14 are in general alignment and in communication of any material deposited first through the center opening 18 of the toilet seat 17.

Figure 1B:
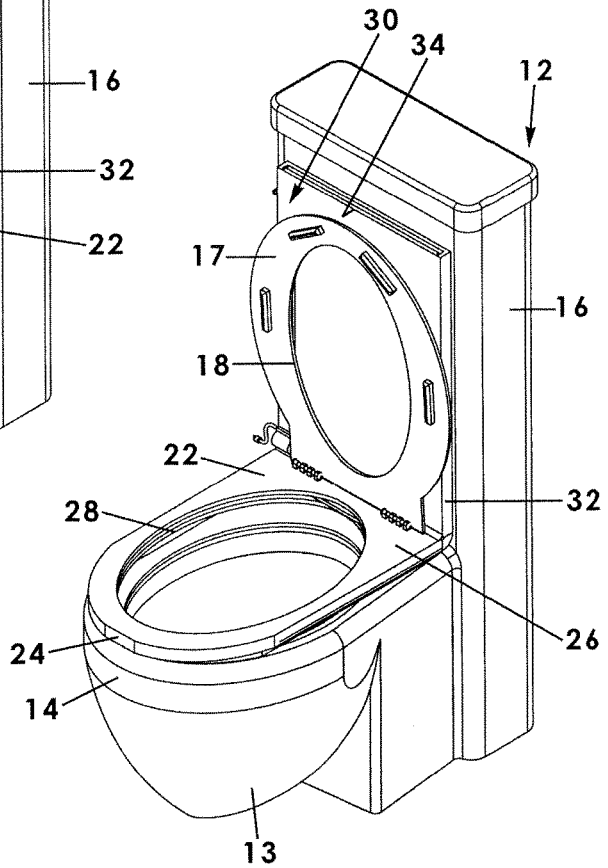
FIG. 1*b* is another perspective view of the toilet cover apparatus as in FIG. 1*a*, illustrated with the toilet seat in a raised configuration.
Figure 2:
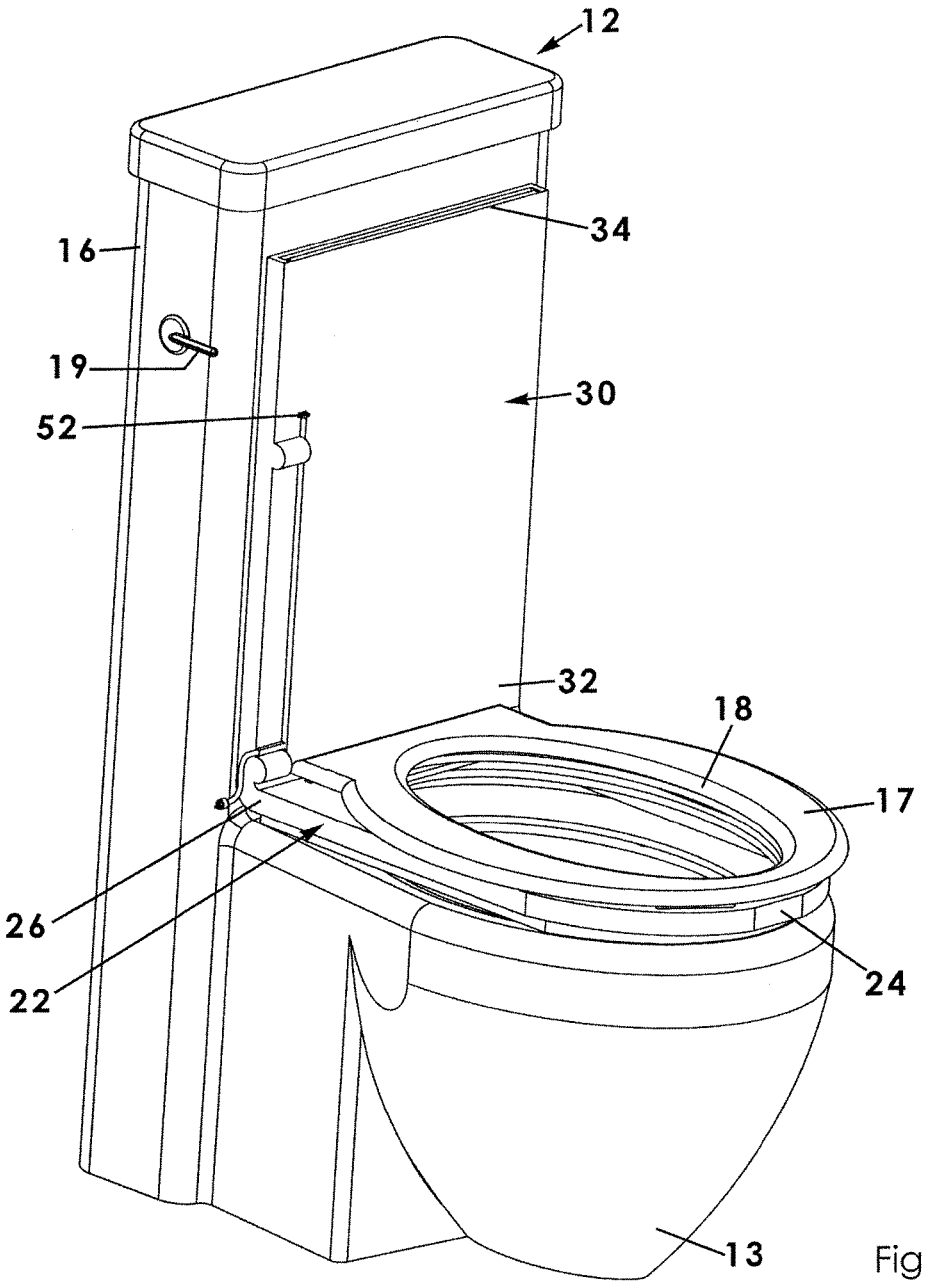
FIG. 2 is a perspective view from another angle of the toilet cover apparatus as in FIG. 1*a;*
Figure 3:
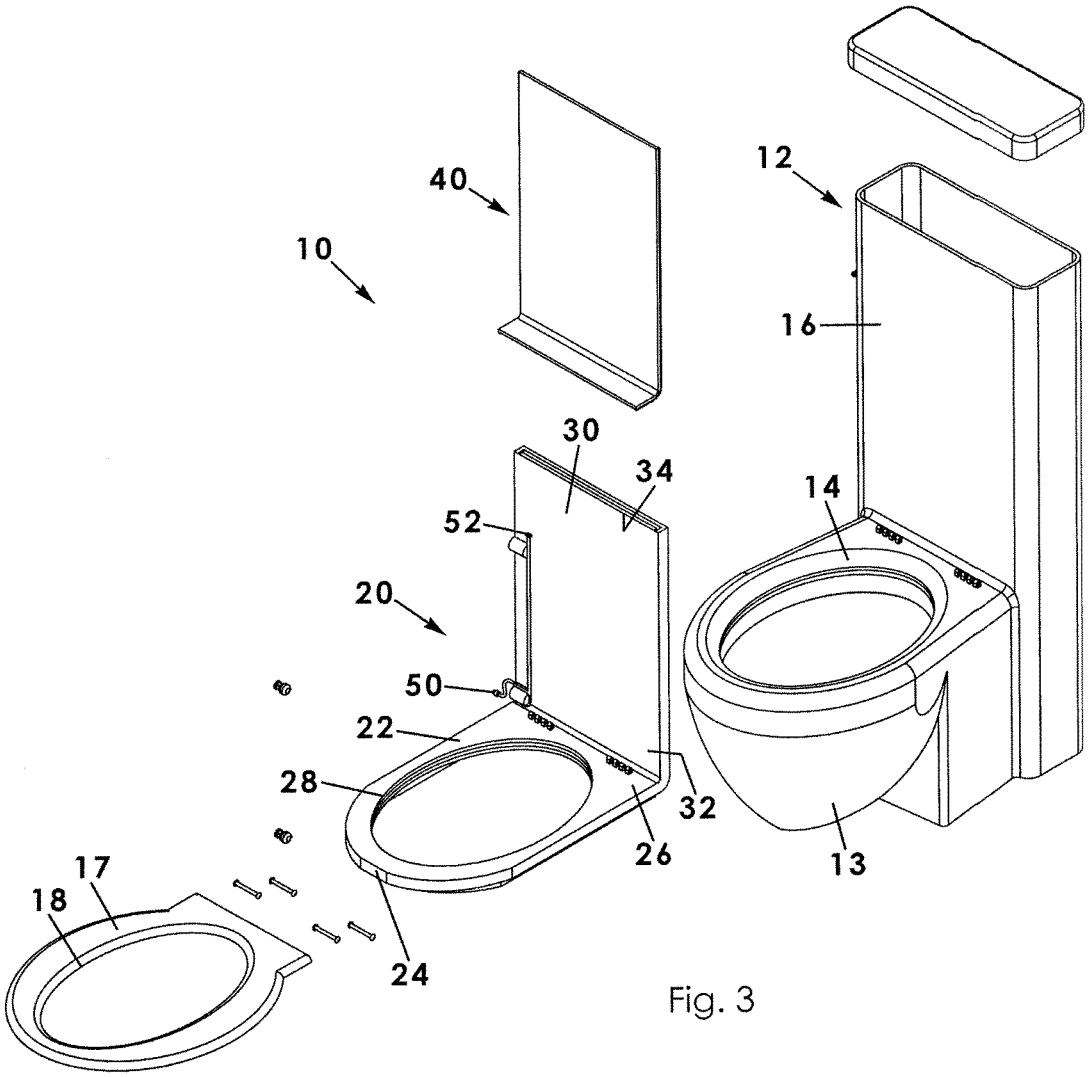
FIG. 3 is an exploded view of the toilet cover apparatus as in FIG. 1.
Figure 4A:
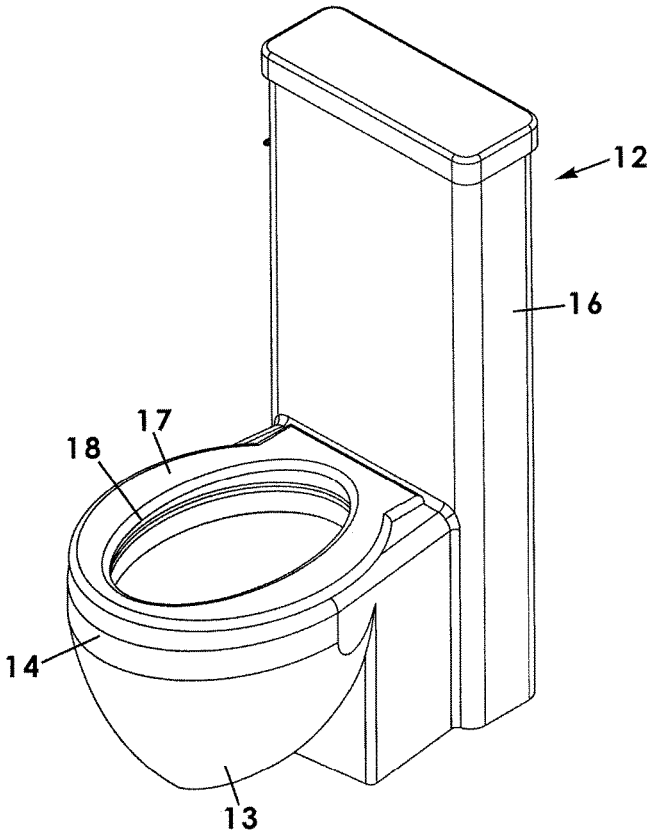
FIG. 4*a* is a perspective view of a toilet cover apparatus according to another embodiment of the present invention illustrated with a toilet seat in a lowered configuration.
Figure 4B:
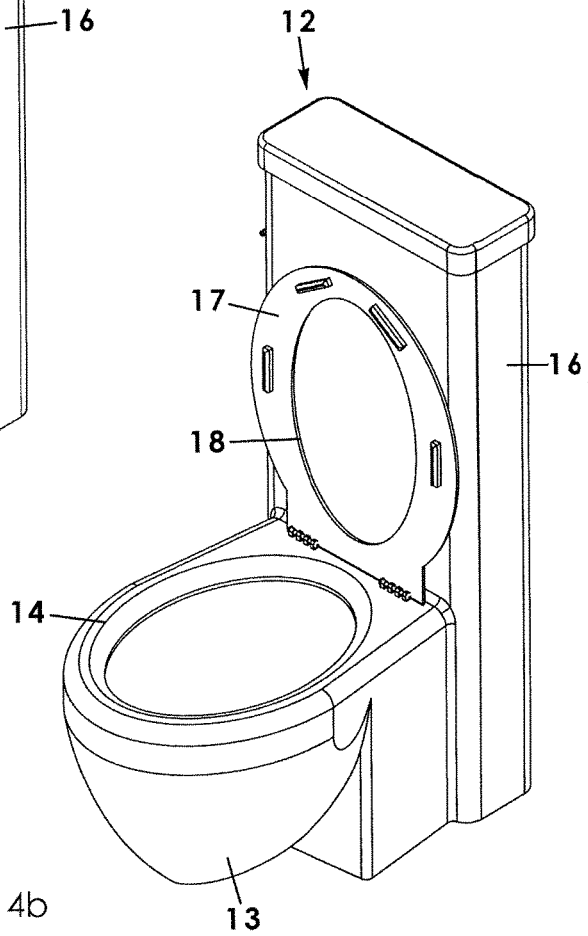
FIG. 4*b* is another perspective view of the toilet cover apparatus as in FIG. 4*a*, illustrated with the toilet seat in a raised configuration.
Figure 4C:
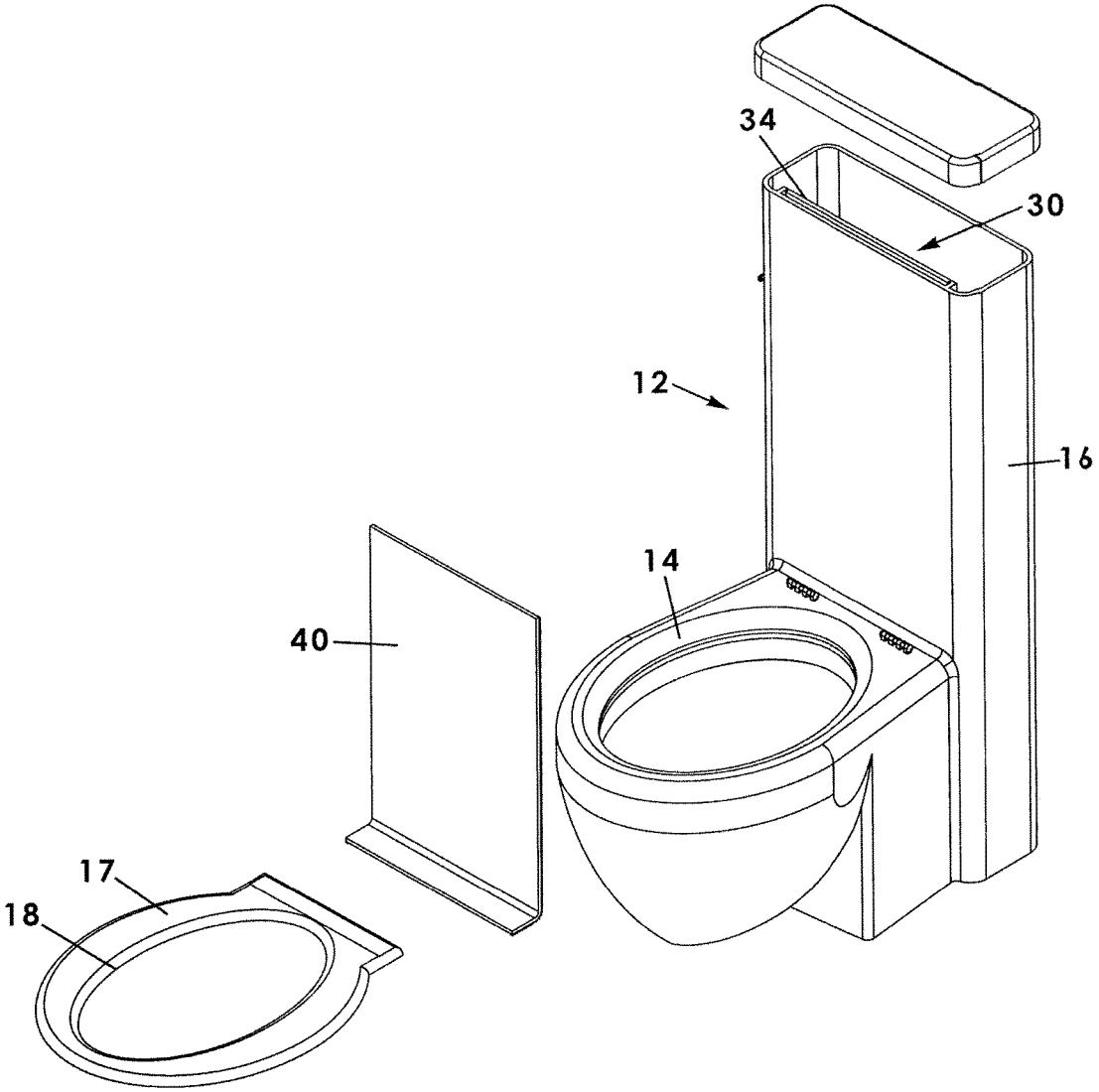
FIG. 4*c* is an exploded view of the toilet cover apparatus as in FIG. 4*a;*
Figure 5:
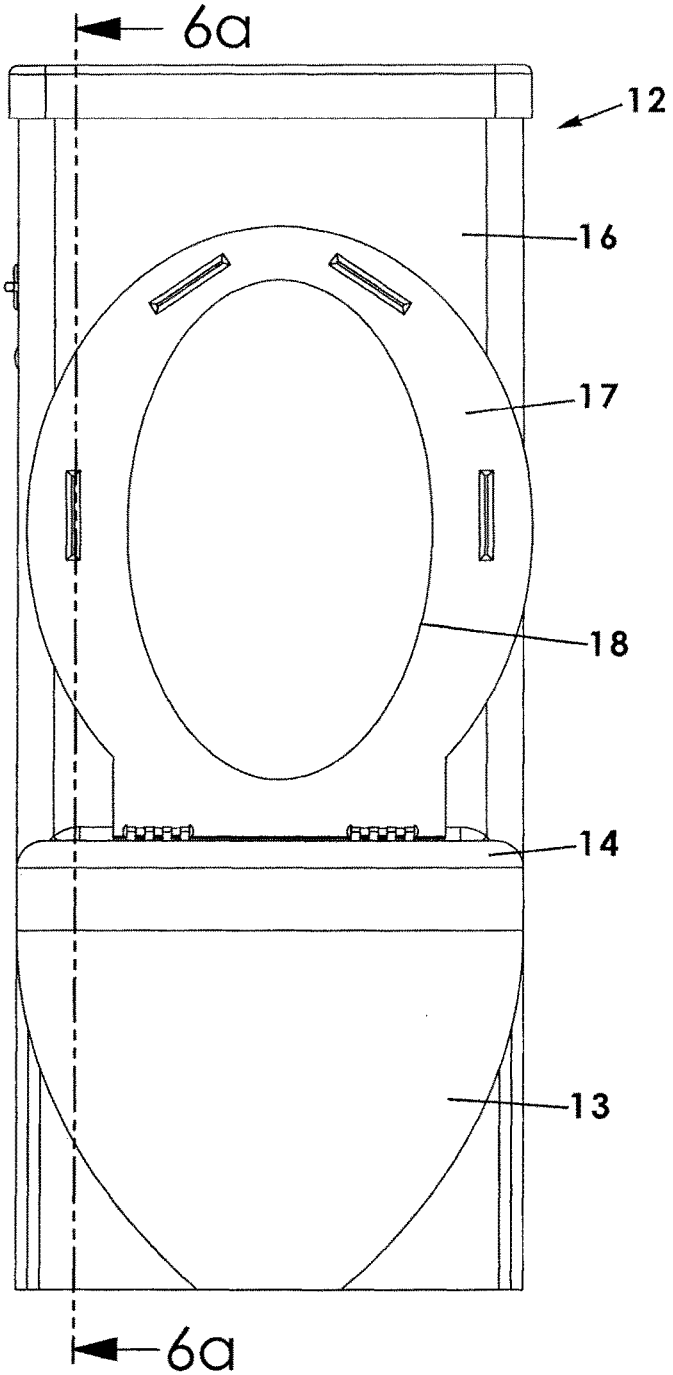
FIG. 5 is a front view of the toilet cover apparatus as in FIG. 4*a;*

In an embodiment, the lower portion 22 of the lid housing 20 may be situated atop the upper rim 14 of the toilet bowl 13 of the toilet 12. In this embodiment, the upper portion 30 of the lid housing 20 is situated adjacent and parallel to an exterior front surface of the tank 16 of the toilet 12 (FIG. 1). It is understood that the lid housing 20 may be coupled to the upper rim 14 of the toilet bowl 13 or to the tank 16 or may be configured to rest thereupon in a stable manner without the aid of fasteners. Preferably, the toilet seat 17 described above is pivotally connected to a top surface of the lower portion 22 adjacent the rear end 26 thereof. The toilet seat 17, therefore, is situated atop the lid housing 20. Then, when the lid member 40 is positioned at the deployed configuration (covering the opening 28), the interior of the toilet bowl 13, including waste, bacteria, or germs, is blocked from any contact with the toilet seat 17 or a user seated thereupon or from becoming airborne upon a flushing operation of the toilet 12.

In an embodiment, the lid housing 20 is positioned inside the toilet 12 rather than situated outside of the toilet 12. More particularly, the lower portion 22 of the lid housing 20 is positioned within the toilet bowl 13 above the surface of the water contained therein. Further, the lower portion 22 may have a unitary construction with the upper rim 14 of the toilet bowl 13 as shown in FIG. 6*a*. Further, the upper portion 30 of the lid housing 20 may be positioned inside an interior area defined by the tank 16 of the toilet 12. As in the embodiment first described previously, the lower portion 22 of the lid housing 20 is situated beneath the toilet seat 17 so as to completely prevent contact between the toilet seat 17 and the interior of the toilet bowl 13 when the lid member 40 is at the deployed configuration. Conversely, however, the center opening 18 of a toilet seat 17, the open top of the upper rim 14, and the opening defined by the lower portion 22 of the lid housing 20 are in fluid communication when the lid member 40 is at the retracted configuration.

In use, the toilet bowl cover apparatus 10 may be installed on a traditional toilet 12, such as by positioning the lower portion 22 of the lid housing 20 atop the upper rim 14 of the toilet bowl 13. The toilet seat 17 may need to first be removed in order to situate the lid housing 20. Then, the toilet seat 17 may be mounted atop the lower portion 22 of the lid housing 20 for pivotal operation in the normal manner. When a user desires to use the toilet 12, he may operate the actuator 52 to position the lid member 40 at the retracted configuration, thus allowing waste to be collected in the toilet bowl 13. Then, the user may use the actuator 52 to cause the lid member 40 to move to the deployed configuration—which blocks communication between the contents of the toilet bowl 13 and the toilet seat 17, top of the upper rim 14, or with the ambient air. Finally, the user may flush the toilet bowl 13 with a traditional flush handle 19.

It is understood that while certain forms of this invention have been illustrated and described, it is not limited thereto except insofar as such limitations are included in the following claims and allowable functional equivalents thereof.

The invention claimed is:

1. A toilet bowl cover apparatus for use with a toilet that includes a toilet bowl having an upper rim defining an open top and a tank extending upwardly from said toilet bowl, said toilet cover apparatus comprising:

a lid housing comprising a lower portion having opposed front and rear ends and an upper portion having opposed lower and upper ends, said lower end of said upper portion being connected to said rear end of said lower portion such that said upper portion extends upwardly relative to said lower portion;

wherein said lower and upper portions of said lid housing are configured to together define a continuous interior channel between said front end and said upper end;

a lid member situated in said interior channel and having a flexible construction, said lid member being slidably movable between a retracted configuration substantially in said interior channel of said upper portion and a deployed configuration substantially in said interior channel of said lower portion; and a toilet seat operatively coupled to a top surface of said lid housing and selectively movable between a raised configuration generally parallel to said upper portion of said lid housing and a lowered configuration generally parallel to said lower portion of said lid housing;

wherein said lower portion of said lid housing defines an opening having a shape that is complementary to a center opening of the toilet seat and to said open top of the upper rim of the toilet bowl;

whereby said lid member prevents communication between said toilet bowl and said toilet seat when positioned at said deployed configuration and allows communication between said toilet bowl and said toilet seat when positioned at said retracted configuration;

wherein said lower portion of said lid housing has a unitary construction with the upper rim of said toilet bowl;

wherein said upper portion of said lid housing is positioned inside an interior area of the tank.

2. The toilet bowl cover apparatus as in claim 1, wherein said lid member has length and width dimensions sufficient to completely cover said open top of said lower portion of said lid housing when positioned at said deployed configuration.

3. The toilet bowl cover apparatus as in claim 2, wherein said lower portion of said lid housing is positioned atop the upper rim of said toilet bowl.

4. The toilet bowl cover apparatus as in claim 3, wherein said upper portion of said lid housing is positioned exteriorly adjacent a front surface of the toilet tank.

5. The toilet bowl cover apparatus as in claim 1, further comprising at least one motor/gear combination situated in said interior channel of said upper portion of said lid housing, said at least one motor/gear combination having a plurality of gear teeth;

wherein said lid member includes a plurality of lid teeth operatively engaged with said gear teeth such that said lid member is moved between said retracted configuration and said deployed configuration when said motor/gear combination is energized.

6. The toilet bowl cover apparatus as in claim 5, comprising a power cord electrically connected to said motor/gear combination and selectively connected to an AC electrical source.

7. The toilet bowl cover apparatus as in claim 5, comprising an actuator coupled to said motor/gear combination configured to selectively energize said motor/gear combination to move said lid member.

8. The toilet bowl cover apparatus as in claim 1, wherein said open top of said lower portion and said opening of said seat are aligned and allow access to said toilet bowl when said lid member is positioned at said retracted configuration.

9. A toilet bowl cover apparatus, comprising:

a toilet having a toilet bowl configured to hold water and collect waste and a tank extending upwardly from a rear end of said toilet bowl configured to hold a quantity of refill water, said toilet bowl having an upper rim defining an open top;

a toilet seat pivotally coupled to an upper surface of said upper rim adjacent said rear end of said toilet bowl and movable between a lowered configuration adjacent said upper rim and an open configuration upwardly displaced from said upper rim, said toilet seat defining a center opening normally aligned and in communication with said open top of said upper rim;

a lid housing comprising a lower portion having opposed front and rear ends and an upper portion having opposed lower and upper ends, said lower end of said upper portion being coupled to said rear end of said lower portion such that said upper portion extends upwardly relative to said lower portion;

wherein:

said lower and upper portions of said lid housing are configured to together define a continuous interior channel;

said lower portion of said lid housing has a unitary construction with an upper rim of said toilet bowl such that said lower portion is situated beneath said toilet seat, said lower portion defining an opening normally in communication with said center opening of said toilet seat and said open top of said toilet bowl; and said upper portion of said lid housing is situated inside said tank; and a lid member situated in said interior channel and having a flexible construction, said lid member being slidably movable between a retracted configuration substantially in said interior channel of said upper portion and a deployed configuration substantially in said interior channel of said lower portion;

whereby said lid member prevents communication between said toilet bowl and said toilet seat when positioned at said deployed configuration and allows communication between said toilet bowl and said toilet seat when positioned at said retracted configuration.

10. The toilet bowl cover apparatus as in claim 9, wherein said lid member has length and width dimensions sufficient to completely cover said opening of said lower portion of said lid housing when said lid member is positioned at said deployed configuration.

11. The toilet bowl cover apparatus as in claim 10, further comprising at least one motor/gear combination situated in said interior channel of said upper portion of said lid housing, said at least one motor/gear combination having a plurality of gear teeth;

wherein said lid member includes a plurality of lid teeth operatively engaged with said gear teeth such that said lid member is moved between said retracted configuration and said deployed configuration when said motor/gear combination is energized.

12. The toilet bowl cover apparatus as in claim 11, comprising a power cord electrically connected to said motor/gear combination and selectively connected to an AC electrical source.

13. The toilet bowl cover apparatus as in claim 12, comprising an actuator coupled to said motor/gear combination configured to selectively energize said motor/gear combination to move said lid member.

14. The toilet bowl cover apparatus as in claim 9, wherein said upper portion of said lid housing has a unitary construction with said tank.

* * * * *